US006066033A

United States Patent [19]

Kamiya et al.

[11] Patent Number: 6,066,033

[45] Date of Patent: May 23, 2000

[54] ROTATIONAL SPEED ADJUSTING DEVICE FOR A PNEUMATIC ROTATIONAL TOOL

[75] Inventors: Tadashi Kamiya, Kawasaki; Toshiro Iritani, Sagamihara, both of Japan

[73] Assignee: K-R Industry Company Limited, Japan

[21] Appl. No.: 09/312,820

[22] Filed: May 17, 1999

[30] Foreign Application Priority Data

Jul. 29, 1998 [JP] Japan ..... 10-214162

[51] Int. Cl.[7] ..... B24B 23/00; B24B 27/08

[52] U.S. Cl. ..... 451/359; 451/353; 451/344

[58] Field of Search ..... 173/170, 93, 93.5, 173/18, 169; 415/DIG. 904, 202, 119; 416/145; 451/158, 259, 350, 353, 359, 357, 358, 352, 344, 548

[56] References Cited

U.S. PATENT DOCUMENTS 4,434,858 3/1984 Whitehouse ..... 173/12
4,773,487 9/1988 Ringer ..... 173/18

*Primary Examiner*—Derris Holt Banks
*Attorney, Agent, or Firm*—Lorusso & Loud

[57] ABSTRACT

To provide a rotational speed adjusting device for a pneumatic rotational tool in which even if high air pressure is supplied, rotational frequency thereof does not exceed the maximum allowable rotational frequency so as to prevent occurrence of breakage of a processing tool. A speed adjusting shaft 30 is secured to one end of a rotor 26, and a speed adjusting member 32 capable of being displaced with respect to the speed adjusting shaft 30 is mounted externally of the speed adjusting shaft 30. The speed adjusting shaft 30 is provided with a ball 44 movable in a radial direction, and the speed adjusting member 32 is axially displaced with respect to the speed adjusting shaft 30 by a centrifugal force applied to the ball 44. In the displaced position of the speed adjusting member 32 in the case where the rotational frequency of the rotor 26 reaches the allowable rotational frequency, a section of an air introducing passage 12 formed by the speed adjusting member 32 and a venturi portion 48 of a main body 10 is restricted so as to reduce a quantity of supplied air passing therethrough. By the restricted quantity of air, the rotational frequency of the rotor 26 is so restricted as not to exceed the allowable rotational frequency of a processing tool 16. A space 62 is formed between an end closing portion 52 of the speed adjusting member 32 and an end surface of the speed adjusting shaft 30. A small through hole 58 formed in a projection portion 54 of the end closing portion 52 of the speed adjusting shaft 30 has one part communicated with the space 62 and the other communicated with the air introducing passage 12. The axial expansible vibration of the speed adjusting member 32 is prevented by the resistance of air which moves in and out of the space 62 passing through the small through hole 58.

6 Claims, 7 Drawing Sheets

ROTATIONAL SPEED ADJUSTING DEVICE FOR A PNEUMATIC ROTATIONAL TOOL

BACKGROUND OF THE INVENTION

The present invention relates to a rotational speed adjusting device for a pneumatic rotational tool for controlling the maximum rotational frequency of the pneumatic rotational tool so as not to exceed some extent.

A pneumatic rotational tool such as an air grinder, an air sander and so on is a tool in which a rotational grinding article such as a grindstone or a processing tool such as a rotational polishing article to polish an article to be polished. The processing tool is good in grinding property and polishing property and excellent in workability when the tool is operated at high speed as compared with low speed.

In the pneumatic rotational tool, in general, using pressure (normal pressure) is indicated in an instruction manual or the like. However, the actual circumstances are that the indication of the using pressure is ignored, and the tool is used at far high pressure. As shown in FIG. 7, if air pressure is raised, rotational frequency of the processing tool exceeds allowable rotational frequency as shown by phantom lines (a).

When the pneumatic rotational tool exceeds in allowable rotational frequency, a turning effort (a centrifugal force) in excess of strength exerts on the processing tool to possibly break the processing tool. When the processing tool is broken, the broken matter scatters in all directions so that an operator and persons round are possibly injured, which is very dangerous. From a viewpoint of this, it was necessary for the pneumatic rotational tool such as n air grinder, an air sander and so on to suppress rotational frequency to a level less than the maximum allowable rotational frequency. That is, preferably, the rotational frequency does not exceed allowable rotational frequency as in the solid line (b) in FIG. 7.

Further, for maintaining the pneumatic rotational tool so as not to exceed the allowable rotational frequency, quantity of supplied air is automatically controlled so that rotational frequency of a motor repeats to be increased and decreased within the range of predetermined rotational frequency. There was a disadvantage in that in the repeating operation of increase or decrease of the rotational frequency of a motor, axial expansible vibrations occur in a speed adjusting member of a rotational speed adjusting device.

SUMMARY OF THE INVENTION

The present invention has been accomplished in view of the above drawbacks, and the object of the invention is to provide a rotational speed adjusting device for a pneumatic rotational tool in which even if high air pressure is supplied, rotational frequency thereof does not exceed the maximum allowable rotational frequency whereby a processing tool is not broken.

It is a further object of the invention to provide a rotational speed adjusting device for a pneumatic rotational tool in which unevenness of rotation due to the vibration does not occur.

For achieving the aforementioned object, according to the present invention, there is provided a rotational speed adjusting device for a pneumatic rotational tool, the pneumatic rotational tool comprising a main body formed therein an air introducing passage, a turning effort generating means for generating a turning effort by air supplied from the air introducing passage, and a rotor as a constituent member of the turning effort generating means, characterized in that a venturi portion which is narrow in passage section is formed in the main body, a speed adjusting shaft is secured to one end of the rotor, a speed adjusting member capable of being displaced with respect to the speed adjusting shaft is provided, the speed adjusting member movable in a radial direction with respect to a rotational center axis of the speed adjusting shaft being provided with a ball, the speed adjusting member being displaced in an axial direction of the rotational center axis of the speed adjusting shaft by a centrifugal force applied to the ball, and a section of the air introducing passage between the end of the speed adjusting member and the venturi portion is narrowed at a displaced position of the speed adjusting member when rotational frequency of the rotor reaches a level in the vicinity of allowable rotational frequency so as to provide a quantity of supplied air in which the rotational frequency of the rotor does not exceed allowable rotational frequency.

Further, according to the present invention, the speed adjusting member is in a tubular shape with one end thereof closed, a space is formed between the tubular speed adjusting member with one end thereof closed and an end of a speed adjusting shaft by displacement of the speed adjusting member, and a projecting portion is formed with a small through hole for communication between the space and the air introducing passage to provide a damping effect.

DETAILED DESCRIPTION OF A PREFERRED EMBODIMENT OF THE INVENTION

Figure 1:
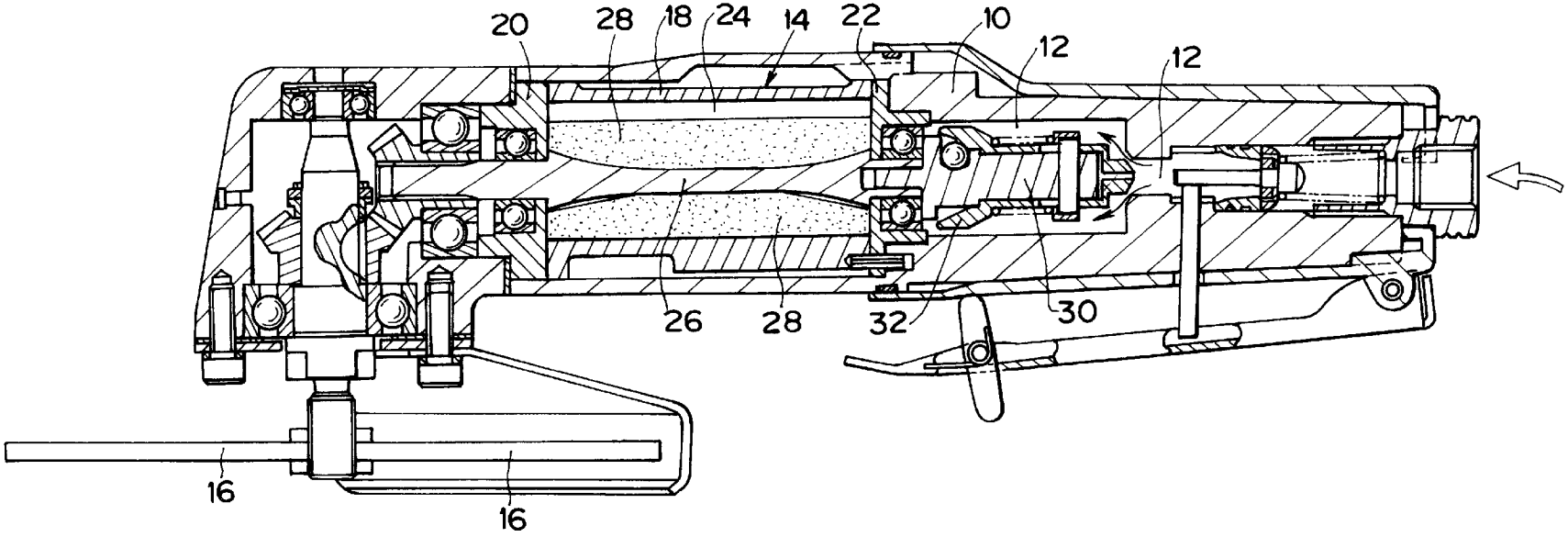
FIG. 1 is a sectional view of the whole of a pneumatic rotational tool provided with a rotational speed adjusting device according to the present invention.
Figure 2:
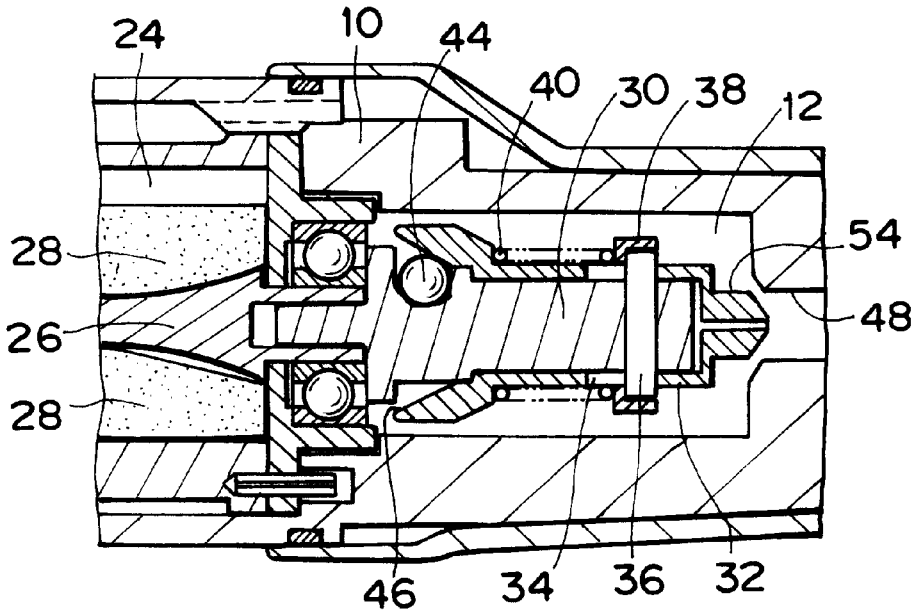
FIG. 2 is an enlarged longitudinal sectional view of main parts in FIG. 1.
Figure 3:
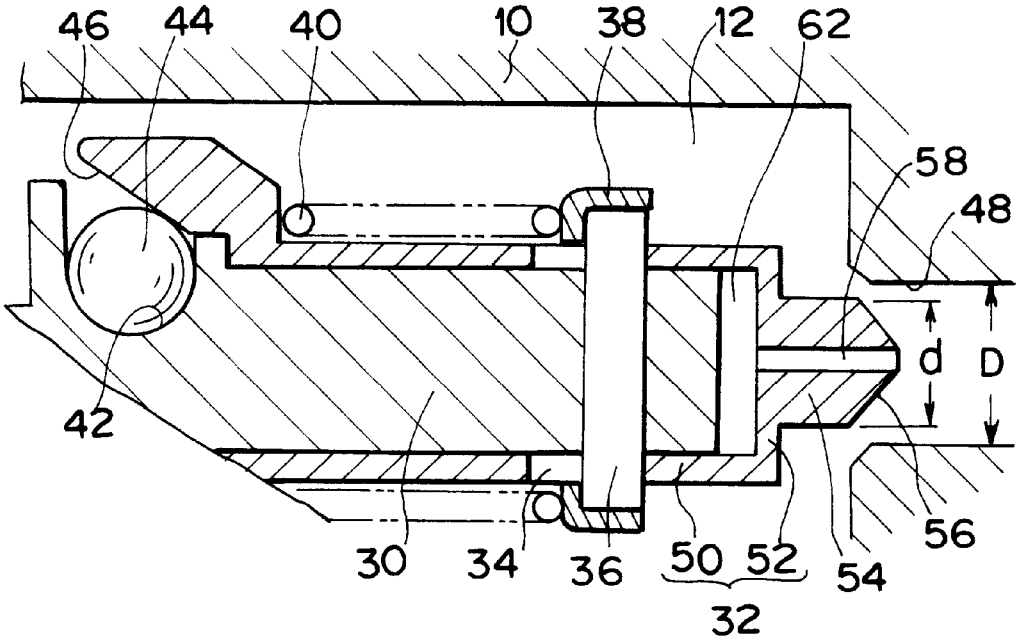
FIG. 3 is an enlarged longitudinal sectional view of main parts in FIG. 2.

A preferred embodiment of the present invention will be described hereinafter with reference to the accompanying drawings, in which FIG. 1 is a sectional view of the whole of a pneumatic rotational tool provided with a rotational speed adjusting device according to the present invention; FIG. 2 is an enlarged longitudinal sectional view of main parts in FIG. 1; and FIG. 3 is an enlarged longitudinal sectional view of main parts in FIG. 2.

The pneumatic rotational tool comprises a main body 10, an air introducing passage 12 formed to introduce pressurized air into the main body 10, and a turning effort generating means 14 for generating a turning effort by air supplied form the air introducing passage 12. A processing tool 16 such as a rotational grinding article such as a grindstone, and a rotational polishing article or the like is mounted on the pneumatic rotational tool.

The turning effort generating means 14 has a cylinder 18 to be a housing, a front plate 20 and a rear plate 22, in which a space 24 is formed interiorly of the housing, the space 24 being interiorly provided with a rotor 26, and a plurality of vanes 28 which are radially moved in and out of the rotor 26. Air is supplied into the space 24 of the turning effort generating means 14 from the air introducing passage 12, and the supplied air impinges upon the vanes 28 to rotate the rotor 26 whereby the processing tool 16 is rotated.

As shown in FIG. 2, to the free end on the rear plate 22 side of the rotor 26 is secured a speed adjusting shaft 30 with a rotational center axis being the same. This speed adjusting shaft 30 is positioned within the air introducing passage 12. A cap-like speed adjusting member 32 is put over the speed adjusting shaft 30, and the tubular inner wall of the speed adjusting member 32 is set so as to be moved while sliding contact with the outer wall of the speed adjusting shaft 30. The speed adjusting member 32 is formed in the tubular side with a pair of holes 34 in an axial direction.

A pin 36 extending through the speed adjusting shaft 30 and the holes 34 of the speed adjusting member 32 at light angles to the axial direction is secured to the speed adjusting shaft 30, and the opposite ends of the pin 36 project externally of the holes 34 of the speed adjusting member 32.

A cover 38 is put over the opposite ends of the pin 36 projecting externally of the holes 34 of the speed adjusting member 32, and a spring 40 is provided between the cover 38 and the rear plate 22 side of the speed adjusting member 32. This spring 40 is provided to always bias the speed adjusting member 32 toward the rotor 26 side.

The speed adjusting shaft 30 is formed in the surface at right angles to the axial center with a plurality of holes 42 which extend somewhat inwardly toward the axial center from the outer surface, each hole 42 being provided with a ball 44.

The inner wall in the vicinity of the tubular end of the cap-like speed adjusting member 32 is in the form of an inclined wall 46 having a shape gradually opened toward the outside from the anal direction. The ball 44 is in contact with the inclined wall 46.

A venturi portion 48 is formed as shown in FIG. 3 halfway of the air introducing passage 12 formed within the main body 10. Let D be the diameter of the venturi portion 48.

The cap-like speed adjusting member 32 comprises, as shown in FIG. 3, a tubular portion 50 externally of the speed adjusting shaft 30, an end closing portion 52, and a projecting portion 54 formed in the end closing portion 52 and having the diameter small than that of the tubular portion 50. Further, a taper portion 56 to be converged closer to the end is formed in the vicinity of the end of the projecting portion 54. Let d be the diameter of the large diameter portion of the projecting portion 54. Then, the diameter d is set to be smaller than the diameter D of the venturi portion 48.

While in the cap-like speed adjusting member 32, the outside diameter of the root of the taper-like projecting portion 54 is made smaller than the outside diameter of the tubular portion 50, it is to be noted that the outside diameter of the root of the taper-like projecting portion 54 can be made the same as that of the tubular portion 50. Further, the taper-like configuration can be made a straight like configuration.

The projecting portion 54 is formed with a small through hole 58 extending therethrough and communicating with the interior of the tubular portion 50. In the case where the end closing portion 52 is not formed with the projecting portion 54, a small through hole 58 communicating with the interior of the end closing portion 52 can be formed.

The operation of the above-described embodiment will be described hereinafter.

When a quantity of pressurized air supplied from the air introducing passage 12 increases, the rotational frequency of the rotor 26 of the turning effort generating means 14 increases, and the rotational frequency of the speed adjusting shaft 30 secured to the rotor 26 also increases. When the rotational frequency of the speed adjusting shaft 30 increases, the centrifugal force is applied to the ball 44 received in the hole 42.

Figure 4:
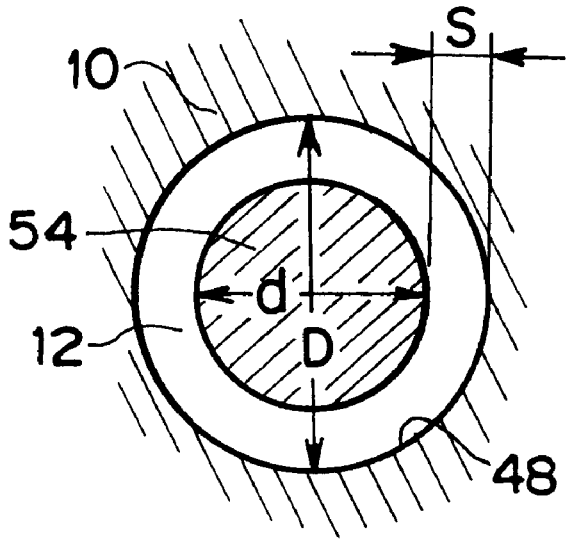
FIG. 4 is a sectional view of main parts of a main body in a venturi portion and a speed adjusting member.
Figure 5:
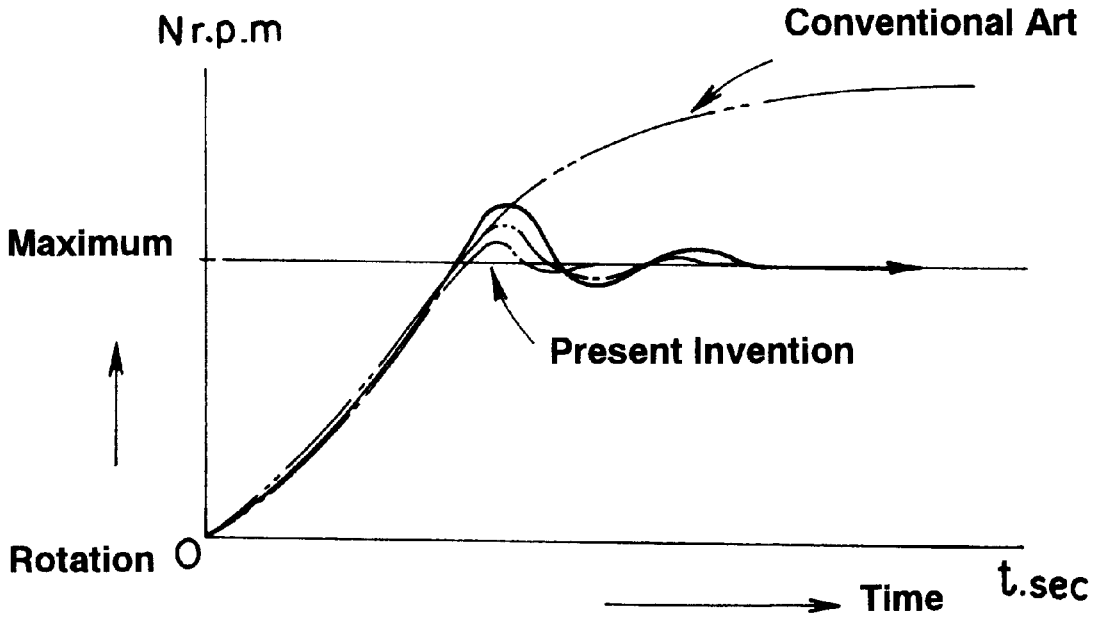
FIG. 5 is a characteristic view of rotational frequency of a pneumatic rotational tool provided with a rotational speed adjusting device according to the present invention and time.

The force for pressing the inclined wall 46 by the ball 44 increases as the rotational frequency of the speed adjusting shaft 30 increases to move the speed adjusting member 32 rightward as viewed in FIGS. 2 and 3. That is, the speed adjusting member 32 is moved rightward as viewed in FIGS. 2 and 3 in response to the rotational frequency of the speed adjusting shaft 30. When the rotational frequency of the speed adjusting shaft 30 exceeds a predetermined level, the projecting portion 54 of the speed adjusting member 32 runs into the venturi portion 48, and a passage section of the air introducing passage 12 in the venturi portion 48 narrows as shown in FIGS. 3 and 4 so that the quantity of air supplied from the air introducing passage 12 to the turning effort generating means 14 is restricted. Consequently, the rotational frequency of the speed adjusting shaft 30 will not greatly exceed the maximum allowable rotational frequency as shown in FIG. 5.

Figure 6:
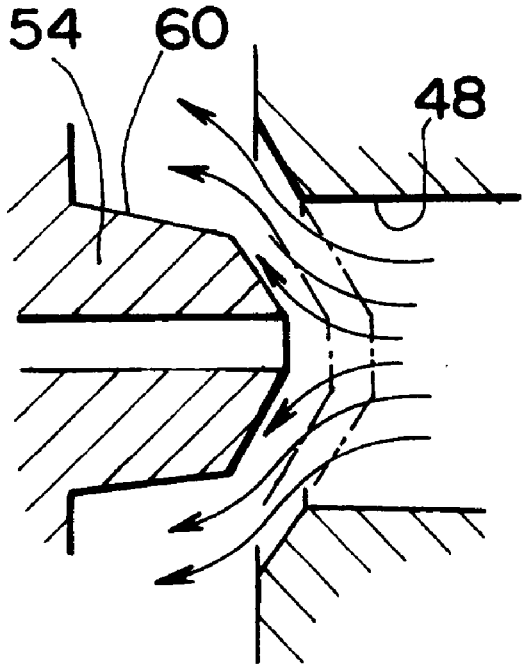
FIG. 6 is a partial sectional view showing the other shape of the speed adjusting member.
Figure 7:
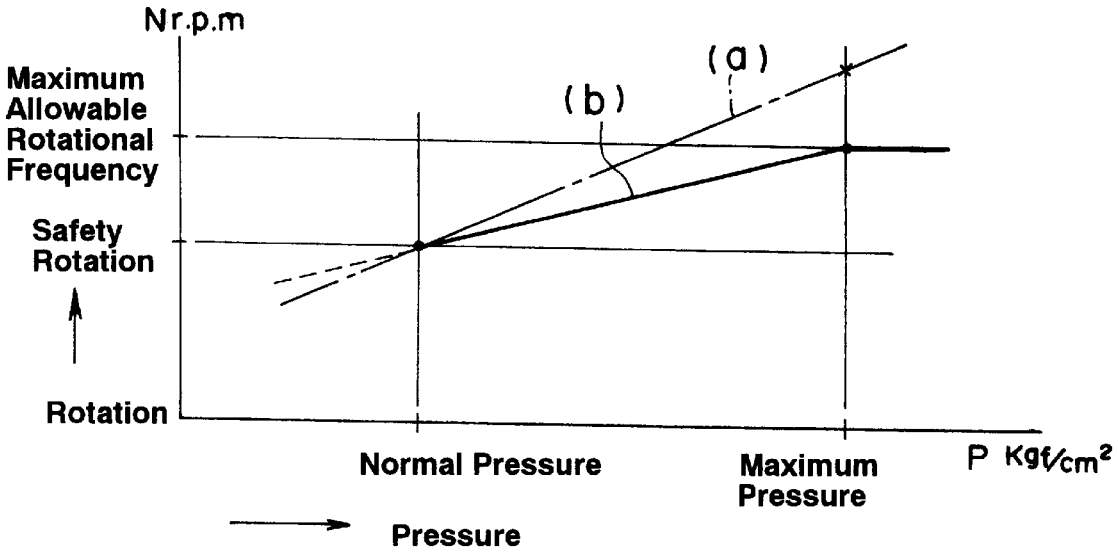
FIG. 7 is a characteristic view of rotational frequency of a conventional pneumatic rotational tool and pressure.

By the provision of the taper portion 56 to be converged in the vicinity of the end of the projecting portion 54, a flow of air is smooth, and responsiveness and stability are improved. While in FIGS. 1 to 3, the taper portion 56 is provided only in the vicinity of the end of the projecting portion 54, as shown in FIG. 6, it is to be noted that a taper portion 60 to be converged over the full length in an axial direction of the projecting portion 54 can be formed. Note that the projecting portion 54 can be cylindrical in shape.

As shown in FIG. 4, a space S between the main body 10 in the venturi portion 48 and the projecting portion 54 can be enlarged by further narrowing the projecting portion 54. Therefore, even if the projecting portion 54 is somewhat oscillated due to the vibration of the pneumatic rotational tool or the like, the main body 10 in the venturi portion 48 is not in contact with the projecting portion 54, not influencing on the sliding property of the speed adjusting member 32.

As shown in FIG. 3, when the speed adjusting member 32 is displaced in a direction away from the speed adjusting shaft 30, a space 62 is formed between the end closing portion 52 of the speed adjusting member 32 and the end surface of the speed adjusting shaft 30. A small through hole 58 formed in the projecting portion 54 of the end closing portion 52 of the speed adjusting shaft 30 has one part communicated with the space 62 and the other communicated with the air introducing passage 12.

If the speed adjusting member 32 is not formed with the small through hole 58 extending to the space 62, when the volume of the space 62 increases, high negative pressure is generated within the space 62 so that responsiveness and stability of the speed adjusting member 32 are deteriorated. For this reason, the speed adjusting member 32 is formed with the small through hole 58 for communication between the space 62 and the air introducing passage 12 whereby air moves in and out of the space 62 from the small through hole 58 to enable smooth movement of the speed adjusting member 32.

In the conventional rotational speed adjusting device for the tool, there was a drawback in that repeated operation of increase or decrease in rotational frequency of a motor is carried out to produce uneven rotation of a rotor. In the present invention, there was the possibility that due to the weight of the ball 44 which generates the centrifugal force, the strength of the spring 40, the sliding resistance of the sliding portion between the speed adjusting shaft 30 and the speed adjusting member 32, and the condition of flow rate and pressure of supplied air, the speed adjusting member 32 axially vibrates with respect to the speed adjusting shaft 30, and the quantity of inflow air is changed by the vibration so that uneven rotation of the rotor 26 occurs due to the change of the quantity of inflow air.

However, by the formation of the small through hole 58 for communication between the space 62 and the air introducing passage 12 in the speed adjusting member 32, the resistance of air moving in and out of the small through hole 58 overcomes the axial vibration of the speed adjusting member 32 with respect to the speed adjusting shaft 30. That is, when the rotation of the turning effort generating means 14 increases, the inflow resistance of air which moves to the space 62 via the small through hole 58 from the air introducing passage 12 occurs, which inflow resistance of air prevents the axial vibration generated in the speed adjusting member 32 to prevent the uneven rotation of the rotor 26. Further, when the rotation of the turning effort generating means 14 decreases, the outflow resistance of air which moves to the air introducing passage 12 via the small through hole 58 from the space 62 occurs, which outflow resistance of air prevents the axial vibration generated in the speed adjusting member 32 to prevent the uneven rotation of the rotor 26.

If the diameter of the small through hole 58 is set to 0.5 mm to 2 mm (including numerical values which are higher or lower than the former), it is possible to eliminate the axial vibration of the speed adjusting member 32 with respect to the speed adjusting shaft 30 and overcome the uneven rotation of the rotor 26. The diameter of the small through hole 58 is set to the small diameter of approximately 0.5 mm to 2 mm whereby the resistance of air passing through the small through hole 58 can be sufficiently used. And, it is possible to eliminate, by the air resistance, the vibration generated in the speed adjusting member 32 of the rotational speed adjusting device and prevent the uneven rotation of the rotor 26. When the diameter of the small through hole 58 is set to be smaller than 0.5 mm, the resistance of air increases, which is however not preferable in consideration of difficulty of processing of the small through hole 58, clogging of dust or the like. When the diameter of the small through hole 58 is larger than 2 mm, the resistance of air passing through the small through hole 58 decreases to rarely have an effect of suppressing the axial vibration of the speed adjusting member 32.

In the rotational speed adjusting device actually used, since the inside diameter of the space 62 is not more than 50 mm, with respect to the space 62 of any inside diameter between this, the diameter of the small through hole 58 will suffice in the range of from 0.5 mm to 2 mm (including numerical values which are higher or lower than the former).

As described above, according to the rotational speed adjusting device for a pneumatic rotational tool of the present invention, when the rotational frequency of the rotor exceeds a predetermined level, the quantity of supplied air from the air introducing passage to the turning effort generating means is restricted by the speed adjusting member which moves axially with respect to the speed adjusting shaft secured to the rotor. Since when the rotational frequency of the rotor reaches a predetermined value, the quantity of supplied air from the air introducing passage is restricted, the rotational frequency of the rotor can be made not to exceed the maximum allowable rotational frequency. Consequently, it is possible to prevent the processing tool such as a rotational grinding article, a rotational polishing article and so on from being broken.

Further, between the space formed between the speed adjusting shaft and the speed adjusting member and the air introducing passage is formed the small through hole for communication between the space and the air introducing passage, whereby the axial vibration generated in the speed adjusting member can be prevented by the resistance of air passing through the small through hole to prevent the uneven rotation of the rotor for stable rotation.

Furthermore, by the provision of the taper portion in the projecting portion at the end of the speed adjusting member, a flow of air is smooth, and responsiveness and stability can be improved.

What is claimed is:

1. A rotational speed adjusting device for a pneumatic rotational tool, the pneumatic rotational tool comprising a main body having formed therein an air introducing passage, a torque generating means for generating a torque by air supplied from the air introducing passage, said torque generating means including a rotor, a venturi portion formed in the main body, a speed adjusting shaft secured to one end of the rotor, a speed adjusting member capable of being axially displaced with respect to the speed adjusting shaft, a ball movable by centrifical force in a radial direction with respect to a rotational center axis of the speed adjusting shaft, the speed adjusting member being axially displaced along the rotational center axis of the speed adjusting shaft by the radial movement of the ball, wherein a section of the air introducing passage between an end of the speed adjusting member and the venturi portion is narrowed by axial displacement of the speed adjusting member when a rotational speed of the rotor reaches a level in the vicinity of an allowable rotational speed, so as to limit a quantity of air supplied therethrough, so that the rotational speed of the rotor does not exceed the allowable rotational speed.

2. The rotational speed adjusting device for a pneumatic rotational tool according to claim 1 wherein the speed adjusting member is in a tubular shape with one end thereof closed, a space is formed between the tubular speed adjusting member with one end thereof closed and an end of the speed adjusting shaft by displacement of the speed adjusting member, and a projecting portion is formed with a small through hole for communication between the space and the air introducing passage.

3. The rotational speed adjusting device for a pneumatic rotational tool according to claim 2 wherein the diameter of the small through hole is 0.5 mm to 2 mm.

4. The rotational speed adjusting device for a pneumatic rotational tool according to any of claim 1 wherein a surface of the speed adjusting member in contact with the ball comprises an inclined surface inclined in a moving direction of the speed adjusting member.

5. The rotational speed adjusting device for a pneumatic rotational tool according to any of claim 1 wherein in the speed adjusting member, a projecting portion is formed at a position away from the speed adjusting shaft, the projecting portion being formed with a small through hole, and the projecting portion and the venturi portion form a narrow section of the air introducing passage.

6. The rotational speed adjusting device for a pneumatic rotational tool according to claim 5 wherein a taper portion converging toward said end of the speed adjusting member is formed in the vicinity of an end of the projecting portion or in the through hole.

* * * * *

UNITED STATES PATENT AND TRADEMARK OFFICE

CERTIFICATE OF CORRECTION

PATENT NO. : 6,066,033
DATED : May 23, 2000
INVENTOR(S) : Kamiya et al.

It is certified that error appears in the above-identified patent and that said Letters Patent is hereby corrected as shown below:

Column 1,
Line 32, "n" should read -- an --.

Column 2,
Line 62, "form" should read -- from --.

Column 3,
Line 18, "light" should read -- right --;
Line 36, "anal" should read -- axial --;
Line 45, "small" should read -- smaller --.

Column 6,
Line 50, delete "any of";
Line 55, delete "any of".

Signed and Sealed this

Thirtieth Day of October, 2001

*Attest:*

Nicholas P. Godici

NICHOLAS P. GODICI
*Acting Director of the United States Patent and Trademark Office*

*Attesting Officer*